United States Patent [19]

Nojima et al.

[11] Patent Number: 4,686,119

[45] Date of Patent: Aug. 11, 1987

[54] METHOD OF PRODUCING CAST COATED PAPER

[75] Inventors: Kazuhiro Nojima, Kobe; Kouichi Shono, Amagasaki; Mikio Takahashi, Takatsuki, all of Japan

[73] Assignee: Kanzaki Paper Mfg. Co., Ltd., Tokyo, Japan

[21] Appl. No.: 832,477

[22] Filed: Feb. 24, 1986

[30] Foreign Application Priority Data

Feb. 25, 1985 [JP] Japan ..... 60-35698

[51] Int. Cl.[4] ..... B05D 3/12

[52] U.S. Cl. ..... 427/362; 427/366; 427/391

[58] Field of Search ..... 427/362, 366, 391

[56] References Cited

U.S. PATENT DOCUMENTS

Re. 23,637 3/1953 Montgomery ..... 427/362 X
3,113,887 12/1963 Wiebush ..... 427/362

FOREIGN PATENT DOCUMENTS 886462 1/1962 United Kingdom ..... 427/362

*Primary Examiner*—Michael R. Lusignan

[57] ABSTRACT

A method of producing cast coated paper in which a rewetted or gelled coating layer is pressed at a linear pressure of above 120 kg/cm against the highly polished finishing surface of a cast coating drum having a surface temperature of above 90° C. Improved cast coating operations are secured by including in the coating composition and/or in the rewetting liquid or the gelling liquid, a releasing agent selected from the group consisting of a phosphate having a fatty hydrocarbon radical with 6 to 22 carbon atoms, an amine-salt thereof and lecithin.

7 Claims, 2 Drawing Figures

METHOD OF PRODUCING CAST COATED PAPER

FIELD OF THE INVENTION

The present invention relates to a method of producing cast coated paper. More particularly, the invention relates to improvements in the rewet casting method and the gel-casting method in which the coating layer is finished by being pressed at a high pressure against a highly polished finishing surface of a heated drum.

DESCRIPTION OF THE PRIOR ART

Conventional methods of producing cast coated high gloss paper for printing include a wet casting method in which a wet coated layer is finished by being pressed against a highly polished finishing surface of a heated drum, a gel-casting method in which a wet coated layer is gelled and pressed against a highly polished finishing surface of a heated drum, and a rewet casting method in which a wet coated layer is dried, then the layer is plasticized with a rewetting liquid and pressed against a highly polished finishing surface of a heated drum.

In any of these conventional casting methods, a plasticized coating layer is pressed against the finishing surface of a heated drum in adherent contact and then released therefrom. In any of said conventional casting methods, it is very important that the coating layer is stably released from the drum at all times during operations continuing for a long time.

Conventional means for improving the releasability of the coating layer from the drum include applying a releasing agent to the surface of the drum and putting a releasing agent into the coating composition, rewetting liquid or gelling liquid. The releasing agents include fatty acids such as stearic acid and oleic acid and metallic salts thereof; hydrocarbons such as microcrystalline wax and polyethylene emulsion; higher alcohols such as cetyl alcohol and stearyl alcohol; various surface-active agents; and sulfonated oil.

These releasing agents offer no problems in the wet casting method in which the surface temperature of the drum is below 90° C. In the rewet casting method and the gel-casting method, the above-mentioned releasing agents fail to give satisfactory releasability for continued operation over a long production period.

In the rewet casting method and the gel-casting method, the coating layer is dried or gelled before the layer is pressed against the finishing surface of the drum. Therefore, the coating layer can be pressed against the drum having a surface temperature of above 90° C., and the cast coating can be performed at a speed much higher than that of the wet casting method. However, since the degree of plasticization of the coating layer is low when the layer is pressed against the drum, the coating layer is less likely to completely contact the surface of the drum. Particularly when the speed of operation is as high as above 50 m/min, it is necessary to press the coated layer against the drum at a high linear pressure of above 120 kg/cm. If the above-mentioned releasing agents are used in said casting methods using high press-roll pressures, part of the coating layer begins to stick to the surface of the drum and be picked off from the surface of the coating layer (such a defect being called "drum pick") in 5 to 6 hours of continuing operation, and eventually the web of paper may unreleasably stick to the surface of the drum.

The cause of such a trouble is considered to be as follows: The plasticized coating layer becomes sticky on the drum having a surface temperature of above 90° C. The releasing agent layer between the coating layer and the drum is roughened by frictional action at the press nip owing to the high linear pressure of above 120 kg/cm, and the distribution of the releasing agent becomes nonuniform. Therefore, drum pick is liable to occur particularly in high speed operations.

It is possible to increase the amount of the releasing agent to improve the releasability of the coating layer. However, the increase in the amount of the releasing agent will affect the printability of the finished coated paper. For example, ink will not set or dry well. Therefore, at present it is necessary to lower the speed of operation or to stop operation several times a day to apply fatty acid or other agent to the surface of the drum. In the rewet casting method and the gel-casting method performed at a high temperature and a high pressure, an important problem is present as to how to improve the releasability of the coating layer in order to make it possible to continue stable operations over a period of running while retaining good quality.

OBJECT OF THE INVENTION

It is an object of the invention to make it possible to continue operations for a long time without lowering the quality of cast coated paper in the rewet casting method and the gel-casting method in which the coating layer is pressed at a high pressure of above 120 kg/cm against a highly polished drum having a surface temperature of above 90° C., said coating layer being finished at a high speed of above 50 m/min.

SUMMARY OF THE INVENTION

As a result of extensive study of the problem, particularly about the releasability of the coating layer, the inventors have found it possible to achieve the above-mentioned object by using a releasing agent having a specific composition.

The present invention provides a method of producing cast coated paper in which a rewetted or gelled coating layer is pressed at a pressure of above 120 kg/cm against a highly polished drum having a surface temperature of above 90° C., wherein said coating layer and/or a rewetting liquid or a gelling liquid contains a releasing agent comprising at least one selected from the group consisting of a phosphate having a fatty hydrocarbon radical with 6 to 22 carbon atoms, an amine-salt thereof and lecithin.

DETAILED DESCRIPTION OF THE INVENTION

According to the present invention, in the rewet casting method or the gel-casting method adapted to perform cast finish at a specific temperature and pressure, a specific releasing agent comprising at least one selected from the group consisting of phosphates having a fatty hydrocarbon radical with 6 to 22 carbon atoms, amine-salts thereof and lecithin is used as mentioned above. Particularly said amine-salts and lecithin are preferably used because they can be easily put into an aqueous coating composition, rewetting liquid and gelling liquid, and they have good effects.

Releasing agents used in the present invention include triethanolamine salt of monostearyl phosphate, monoethanolamine salt of dioctyl phosphate, triethylamine salt of trilauryl phosphate and lecithin extracted from soybean and egg yolk. Lecithin also includes synthetic phosphatidyl choline derivatives.

As compared with conventional releasing agents such as fatty acid soap and polyethylene emulsion, the above-mentioned specific releasing agents make it possible to continue stable operation of the cast coating process for long periods of time, 8 to 10 hours, or even more than 24 hours according to the conditions of use, without lowering the quality of cast coated paper. It is not apparent why said specific releasing agents have such excellent advantages in the rewet casting method and the gel-casting method performed at a high temperature and high pressure. The reason why said specific releasing agents have such excellent advantages seems to be that, as compared with the conventional releasing agents, the above-mentioned specific releasing agents are more hydrophilic and adhere more strongly and in a larger amount to the interface between the drum and the coating layer.

In the method of producing cast coated paper according to the present invention, the specific releasing agent is put into a coating composition and/or a rewetting liquid or a gelling liquid. When the releasing agent is put into the coating composition, it is desirable that the amount of the releasing agent be in a range of about 0.1 to 4 parts by weight, preferably about 0.3 to 1.5 parts by weight, to 100 parts of pigments by weight. When the releasing agent is put into the rewetting liquid or the gelling liquid, it is desirable that the amount of the releasing agent is adjusted so that the content of the releasing agent is 0.01 to 3% by weight, preferably 0.1 to 1% by weight, of the solution. If the amount of the releasing agent is smaller than the lower limit, the releasing agent does not have a sufficient releasing effect. If the amount of the releasing agent is larger than the upper limit, the releasing agent has a sufficient releasing effect but the quality of the finished cast coated paper, particularly surface gloss and ink setting, will be adversely affected.

When said releasing agent is put into a rewetting liquid, it is possible to improve the surface gloss of the finished cast coated paper by using, along with said releasing agent, an accelerator for plasticization such as phosphate, amine and amido-compound.

In the method of the present invention, the coating composition used for forming the coating layer is similar to a conventional coating composition for cast coated paper and contains, as its main components, pigment and adhesive.

The pigment usable comprises one or more of conventional pigments for coated paper such as clay, kaolin, aluminum hydroxide, calcium carbonate, titanium oxide, barium sulfate, zinc oxide, satin white, and plastic pigment. The adhesive usable comprises one or more of conventional adhesives for coated paper such as casein, soybean protein, synthetic protein and other proteins; conjugated diene polymer latexes such as styrene-butadiene copolymer and methylmethacrylate-butadiene copolymer; acrylic polymer latexes such as acrylic acid ester polymer, methacrylic acid ester polymer and copolymers thereof; vinyl polymer latexes such as ethylene-vinyl acetate copolymer; alkaline soluble or alkaline insoluble polymer latexes obtained by the functional group modification of these polymers by functional group-containing monomer such as carboxylic group or other group; synthetic resins such as polyvinyl alcohol, olefin-maleic anhydride resin, and melamine resin; starches such as cationic starch and oxidized starch; and cellulose derivatives such as carboxymethylcellulose and hydroxyethyl-cellulose.

The amount of the adhesive to be used is 5 to 50 parts, generally 10 to 30 parts, by weight to 100 parts by weight of the of the pigment. Auxiliary agents such as anti-foaming agent, dye stuff and fluidity modifier are used as necessary.

In the present invention, the coating composition is applied in one or more layers onto base paper by means of an on-machine or off-machine coater such as a blade coater, an air knife coater, a roll coater, a brush coater, a curtain coater, a Champflex coater, a bar coater, a gravure coater or a size-press coater. The solids concentration of said coating composition is generally 40 to 70% by weight, preferably 45 to 65% by weight for best runability.

The base paper may be paper or paperboard having a basis weight of 30 to 400 g/m$^2$ used for coated paper or cast coated paper for printing. Such paper is made at an acid or alkaline pH, and medium-grade base paper containing more than about 10% by weight of high yield pulp may also be used. Also, usable as the base paper is coated paper with a pigment coating on the back surface or preliminary coated paper.

The amount of the coating composition applied to the base paper is about 10 to 50 g/m$^2$ (dry basis), most preferably 15 to 35 g/m$^2$ (dry basis) for best paper quality and cast coating speed.

In the rewet casting method, the coating composition applied to the base paper is dried by means of one of usual drying apparatuses for coated paper such as a hot blast dryer, an air-foil dryer, an air-cap dryer, a cylinder dryer, an infrared dryer or an electron ray dryer. The degree of drying of the coated paper varies according to the kind of base paper and the kind of coating composition. The coated paper is dried to a moisture content in a range of generally about 1 to 11%, preferably about 3 to 8%. The dried, coated paper is smoothed by means of a machine calender, a super calender, etc., but it is necessary to avoid an excessive smoothing operation such as will adversely affect bulkiness and stiffness which characterize the cast coated paper.

The rewetting of the dried coated layer and the gelling of the wet coated layer in the gel-casting method may be performed in the same manner as in the conventional casting method.

BRIEF DESCRIPTION OF THE DRAWINGS

The drawings illustrate cast coaters used in the examples of the present invention.

DESCRIPTION OF PREFERRED EMBODIMENTS

The present invention will be described with reference to examples and comparison examples. The invention is not limited to these examples. The parts and percentages in the examples and comparison examples designate parts and percentages by weight, unless otherwise specified.

EXAMPLES 1 TO 4, COMPARISON EXAMPLES 1 TO 3

70 parts of kaolin, 30 parts of precipitated calcium carbonate and 0.5 part of sodium polyacrylate were dispersed in water by means of a Cowles dissolver so as to prepare a pigment slurry having a solids concentration of 60%. 0.5 part of tributyl phosphate as an anti-foaming agent, and adhesives consisting of 7 parts (solids content) of aqueous casein solution having a concentration of 15% dissolved with ammonia and of 18 parts (solids content) of styrene-butadiene copolymer latex ("DL-636" made by Asahi Chemical Industry Co., Ltd., Japan) were added to said pigment slurry. A releasing agent shown in Table 1 and then ammonia and water were added so as to prepare a coating composition having a solids content of 45% and a pH of 9.0. In this way seven different coating compositions were prepared.

Figure 1:
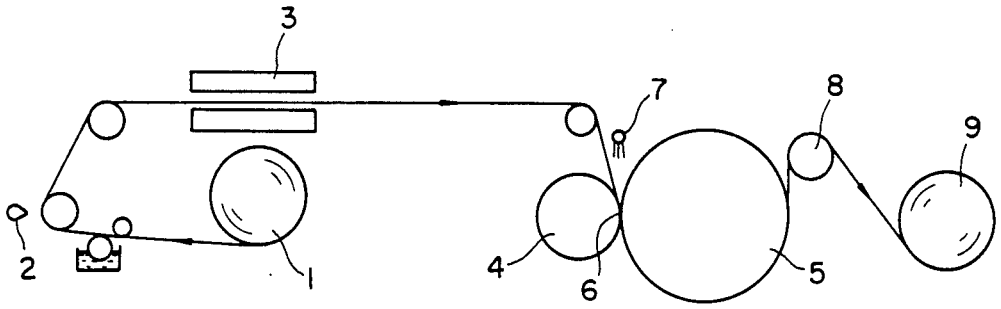
FIG. 1 is a schematic view of a rewet casting method.

With these coating compositions, rewet casting was performed by means of an apparatus shown in FIG. 1.

Each of said coating compositions was applied by means of an air knife coater 2 to a base paper 1 having a basis weight of 80 g/m$^2$ so that the dry coating weight thereof was 28 g/m$^2$. The paper was dried by means of a dryer 3 so that the moisture content in the paper was 6%. Then the paper was passed through a nip 6 between a rubber-covered press roll 4 having a diameter of 750 mm and a chrome-plated cast drum 5 having a diameter of 1500 mm. At said press nip 6 the surface of the coating layer was rewetted with a rewetting liquid supplied by a nozzle 7, said rewetting liquid consisting of 0.3 part of ammonium stearate, 1.0 part of urea and 98.7 parts of water. Next, the paper was pressed by roll 4 at a linear pressure of 250 kg/cm against said casting drum 5 having a surface temperature of 105° C. and rotating at a speed of 70 m/min. After being dried, the paper released from said casting drum 5 at take-off roll 8. Thus was obtained a cast coated paper 9 in each of the Examples and Comparison Examples. Runability and the quality of the cast coated paper in each of Examples and Comparison Examples are shown in Table 1.

TABLE 1

| | Realsing Agent | Amount | Run-ability | Setting of Printing Ink |
|---|---|---|---|---|
| Example 1 | triethanolamine salt of monostearyl phosphate | 0.6 | | |
| Example 2 | monoethanolamine salt of dioctyl phosphate | 0.6 | | |
| Example 3 | lecithin | 0.8* | | |
| Example 4 | lecithin | 1.3* | | |
| Comparison Example 1 | ammonium oleate | 0.6 | XX | |
| Comparison Example 2 | ammonium stearate | 0.6 | X | |
| Comparison Example 3 | ammonium stearate | 1.3 | | X |

(Note: Figures marked * show the amount of lecithin itself used.)

Lecithin used in Examples 3 and 4 was an emulsion obtained by emulsifying a soybean lecithin by means of a nonionic surfactant activator.

Runability and the setting of printing ink were evaluated as follows:

Runability

. . . It was possible to continue operations for more than 24 hours.

. . . It was possible to continue operations for more than 12 hours.

× . . . Drum pick occurred within 12 hours.

×× . . . Drum pick occurred within 5 hours.

Setting of Printing Ink

The setting of printing ink was evaluated 2 hours after the cast coated paper was printed by means of an RI printer (made by Akira Seisakusho Co., Ltd., Japan).

. . . Ink set well without coming off.

× . . . Ink came off by rubbing.

EXAMPLE 5

70 parts of kaolin, 20 parts of precipitated calcium carbonate, 10 parts of aluminum hydroxide, and dispersing agents consisting of 0.5 part of sodium polyacrylate and of 0.5 part of sodium pyrophosphate were dispersed in water by means of a Cowles dissolver so as to prepare a pigment slurry having a solids content of 70%. 0.5 part of tributyl phosphate as an anti-foaming agent, 1.0 part of lecithin (lecithin itself) as a releasing agent, adhesives consisting of 13 parts (solids content) or aqueous casein solution dissolved with ammonia and of 11 parts of styrene-butadiene copolymer latex ("SN-307" made by Sumitomo Naugatuch Co., Ltd., Japan), and water were added to said pigment slurry so as to prepare a coating composition having a solids content of 55%.

Figure 2:
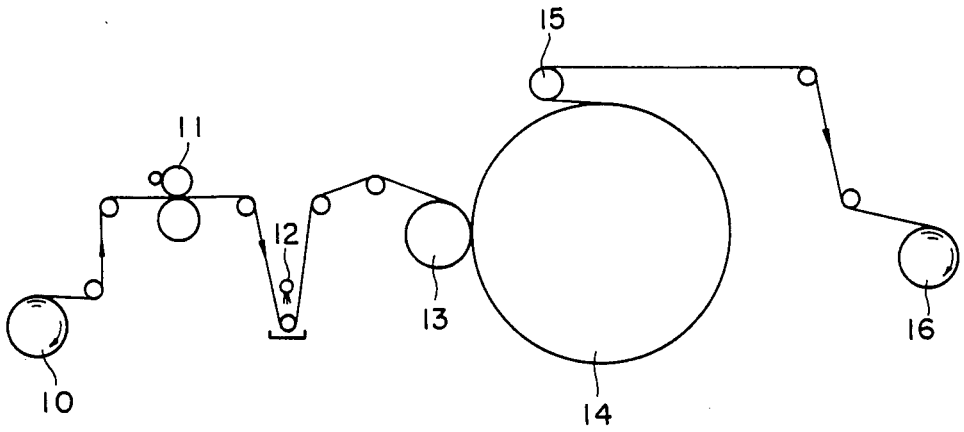
FIG. 2 is a schematic view of a gel-casting method.

With this coating composition, gel-casting was performed by means of an apparatus shown in FIG. 2.

Said coating composition was applied by means of a roll coater 11 to a base paper 10 having a basis weight of 90 g/m$^2$ so that the dry coating weight thereof was 25 g/m$^2$. The coating layer was gelled by being brought into contact with an aqueous solution of calcium formate 12 having a solids concentration of 0.5%. The paper was pressed at a linear pressure of 180 kg/cm between a press roll 13 having a diameter of 800 mm and a casting drum 14 having a surface temperature of 98° C. and a diameter of 3,000 mm. After being dried, the paper released from said casting drum 14 at take-off roll 15. Thus was obtained a cast coated paper 16. It was possible to continue the cast coating operation for 30 hours at a speed of 65 m/min, and the cast coated paper obtained printed well.

COMPARISON EXAMPLE 4

Gel-casting was performed in the same manner as in Example 5 except that 1.0 part (solids content) of polyethylene emulsion was used as a releasing agent in place of 1.0 part of lecithin. Drum pick began to occur in 5 hours of continuous operation, and it was impossible to continue operating any longer.

EXAMPLE 6

Rewet casting was performed in the same manner as in Comparison Example 2 except that a lecithin emulsion having a solids content of 0.5% was used as a rewetting liquid. It was possible to continue operating for 12 hours, and the cast coated paper obtained printed well.

As apparent from the above, according to the present invention, the releaseability of the coated layer from the drum is remarkably improved, and it is possible to continue stable operation of the cast coating process for a long period of time without lowering the quality of the cast coated paper.

What is claimed is:

1. In a method of producing cast coated paper in which a rewetted or gelled coating layer containing as its main components pigment and adhesive is pressed at a linear pressure of above 120 kg/cm against a highly polished finishing surface of a drum having a surface temperature of above 90° C., the improvement characterized in that said coating layer and/or a rewetting liquid or a gelling liquid for said coating layer contains at least one releasing agent selected from the group consisting of lecithin and synthetic phosphatidyl choline derivatives, the amount of said releasing agent present being sufficient to effect release of said cast coated paper from said finishing surface without adversely affecting the quality of said finished cast coated paper.

2. A method of producing cast coated paper as claimed in claim 1, wherein said coating layer contains said releasing agent in an amount of from 0.1 to 4 parts by weight for 100 parts of pigment by weight.

3. A method of producing cast coated paper as claimed in claim 1, wherein the amount of said releasing agent is in a range of 0.3 to 1.5 parts by weight to 100 parts of pigment by weight.

4. A method of producing cast coated paper as claimed in claim 2, wherein said releasing agent is lecithin.

5. A method of producing cast coated paper as claimed in claim 3, wherein said releasing agent is lecithin.

6. A method of producing cast coated paper as claimed in claim 1, wherein the amount of said releasing agent in said rewetting liquid or in said gelling liquid is 0.1% to 3% by weight of said liquids.

7. A method of producing cast coated paper as claimed in claim 1, wherein the amount of said releasing agent in said rewetting liquid or in said gelling liquid is 0.1% to 1% by weight of the liquids.

* * * * *